United States Patent [19]

Rhodes, Jr

[11] 4,264,187

[45] Apr. 28, 1981

[54] DOCUMENT HANDLER

[75] Inventor: John H. Rhodes, Jr, Longmont, Colo.

[73] Assignee: International Business Machines Corporation, Armonk, N.Y.

[21] Appl. No.: 38,581

[22] Filed: May 14, 1979

[51] Int. Cl.[3] ..... G03G 15/00

[52] U.S. Cl. ..... 355/14 SH; 271/245; 271/258; 271/275; 355/3 SH; 355/23

[58] Field of Search ..... 355/14 R, 14 SH, 3 SH, 355/23, 24, 50, 51, 47-49; 271/3.1, 245, 275, 258, 259

[56] References Cited

U.S. PATENT DOCUMENTS

| | | | |
|---|---|---|---|
| 3,815,990 | 6/1974 | Newcomb et al. | 355/3 SH |
| 3,865,482 | 2/1975 | Bendall et al. | 355/14 SH |
| 4,093,372 | 6/1978 | Guenther | 271/3.1 X |
| 4,134,672 | 1/1979 | Burlew et al. | 355/3 SH |

*Primary Examiner*—Richard L. Moses
*Attorney, Agent, or Firm*—Fraser and Bogucki

[57] ABSTRACT

An electrophotographic copier has an extended transport path, including a storage for duplex functions, for copying documents which may be reproduced, to a selectable number of copies, from a master. The master is positioned first at an imaging station, so that the desired number of image transfers to copies can be made. The master document transport system recirculates the imaged master, holding it at a storage station spaced apart from the image station, while a second master is positioned at the image station. The system need not be delayed by requiring that all of the copy documents reach an exit position before the second master is inserted. Moreover if a jam occurs in any of a number of modes of operation the system is able to recall one or two masters as needed to complete the run in most expeditious fashion. By employing a first run adjacent the image station and a second run moving in the opposite direction and adjacent thereto, documents at the storage station may selectively be returned to the image station, to the entry mechanism for the system, or may be exited from the system. When duplex copies are being made from simplex or duplex masters, for example, a jam occurring when copying on the second side is followed by completing the copies in the duplex bin, then recalling the first master to undertake duplex copying of the number of added copies needed to make up the number lost in the jam. The system can therefore operate in semiautomatic or automatic document feeding modes to provide simplex copies, duplex copies from simplex masters, or duplex copies of duplex masters.

11 Claims, 4 Drawing Figures

DOCUMENT HANDLER

BACKGROUND OF THE INVENTION

Developments in the art of electrophotographic copiers have tended to increase both the copying rate and the versatility of the system, while simplifying operative and corrective problems for an operator. Thus high speed copiers are in use which are capable of providing in excess of 75 copies per minute. Along with this it is desirable to provide such features as duplex (two sided) copies of simplex (one sided) masters and duplex copies of duplex masters, all in selectable multiples. The jam condition is detected and indicated automatically, and the number of copy documents made may also be indicated automatically. When a jam occurs, this must be cleared by the operator, but it is desirable that the operator not be required to take the time or make the judgements needed to find and position the proper master, set the machine accordingly, and reinitiate the procedure.

A substantial time disparity can exist in such a system between the completion of image transfer from the master to the imaging system (e.g. an electrostatic drum) and the final delivery of the last reproduced copy to an output device (e.g. an exit tray). As the art has progressed, the amount of exposure time needed has been reduced to a fraction of a second and transport speeds have increased so that total cycle times are now measured in milliseconds rather than seconds. During the interval in which the last reproduced copy is moving out of the system there can be a substantial delay while the copy passes along a long transfer path in which a jam might occur. If a jam occurs somewhere in the copy transport mechanism, the operator must not only clear the jam but restart the copy sequence by resinserting the master. This is particularly troublesome with duplex operations, because the longer and more complex flow path to be followed by the copy documents creates greater susceptibility to jams, and the handling procedure for both originals and copies becomes substantially more complex. If a jam does not occur, the system must further delay operations until the next succeeding master is moved into position. These factors can substantially reduce the throughput of the machine.

In attempting to confront these and other practical problems, semiautomatic and automatic document handlers have been provided in the prior art, of which U.S. Pat. Nos. 3,747,918 and 3,790,158 are examples. It is further known, as evidenced by U.S. Pat. No. 3,588,472, to incorporate control logic and sensors into a system, to track copying in the event that a jam occurs, and to count the number of copies successfully provided. It is also known to recirculate masters to an entry tray after copies have been made, as shown by U.S. Pat. No. 3,790,158. In this system, a master that has been copied is returned to the document supply tray and is stacked on top of a movable ball which separates the copied masters from those yet to be copied.

A particularly versatile example of a semi-automatic document feed system is shown in U.S. Pat. No. 4,090,787 entitled "Automatic Copier Mode Controls" and issued to James Henry Hubbard et al. The referenced patent describes operation in both simplex and duplex modes, as well as the performance of a substantial number of control functions. The prior art has not, as far as is known, provided reliable and inexpensive systems which allow reinitiation of copying procedures in a variety of simplex and duplex modes, while automatically recalling the needed one or two masters for completion of the run, after clearance of a jam.

SUMMARY OF THE INVENTION

Systems in accordance with the invention provide controllable recirculation of master documents past an image station, together with selected delivery back to an entry mechanism or to an exit tray. A master, after imaging, is shifted in a recirculation loop to a storage station spaced apart from the image station, pending detection of satisfactory delivery of the full number of copies desired. In the event that a paper jam occurs in the copy flow path, any of a number of corrective sequences can be automatically undertaken depending on the mode of operation. For example, with simplex masters the next succeeding master that is fed in the interim to the image station can be shifted to the storage station while the prior master is returned to the image station for automatic completion of the run subsequent to clearance of the jam. Where duplex copies are being made of simplex masters, both masters are automatically available for completion of the run. Either or both masters can be placed in position at the image station in a sequence dependent upon when the error occurred and the mode of operation. Masters can be shifted into position at the image station without delaying the sequence to insure that prior copy and transport cycles have been completed, because if a jam occurs the proper master can be retrieved automatically.

In accordance with other features of the present invention, the master document transport mechanism may incorporate a first run for moving master documents to and past the image station, and a second run incorporating the storage station, past which the documents are moved in inverted position and in the opposite direction. This provides a low profile mechanism which, by use of diverters at each end, may selectively recirculate a master, or eject it at different positions along the loop. The same mechanism also permits, through the incorporation of a separate collection tray at the entry end, masters to be received in inverted position suitably oriented for entry into the transport mechanism for making duplex copies from duplex masters. Where simplex masters are used for duplex copies, the recirculation path permits operation without further modification of the feed or handling system. Alternatively, masters may be deposited in an exit tray that is spaced apart from the entry region.

BRIEF DESCRIPTION OF THE DRAWINGS

A better understanding of the invention may be had by reference to the following description, taken in conjunction with the accompanying drawings, in which.

DETAILED DESCRIPTION

Figure 1:
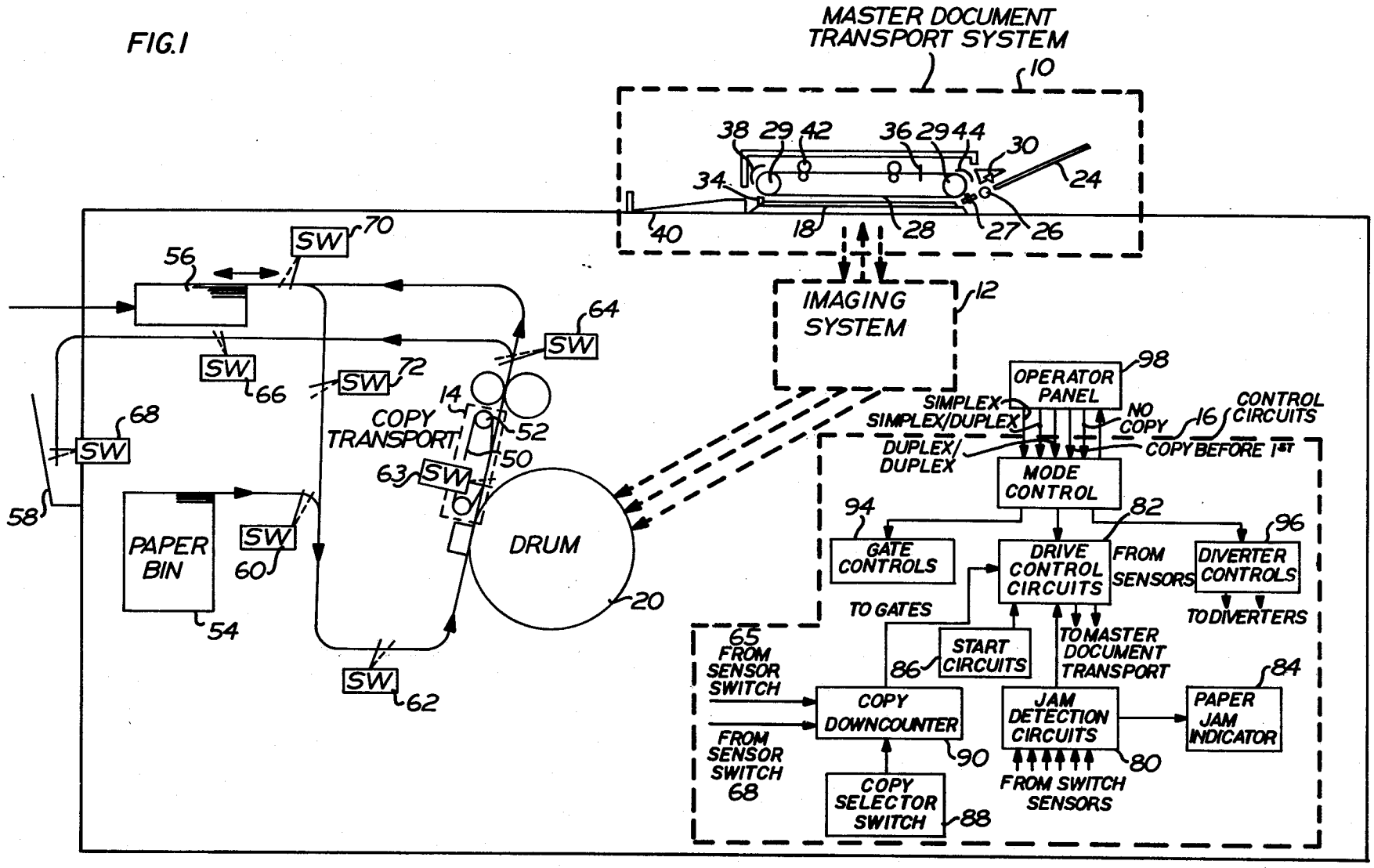
FIG. 1 is a simplified schematic and block diagram representation of a document handler in accordance with the invention.

An example of an electrophotographic copier system using a document handler in accordance with the invention is shown, for simplicity and brevity, in generalized and schematic form in FIG. 1. Details of conventional or previously described subsystems and components have not been depicted where these are not germane to the inventive aspects. For example, the imaging system has been shown only broadly, and a collating system that would typically be employed has not been shown. FIG. 1 therefore depicts only some aspects of a modern, versatile, high speed electrophotographic copy system in which a master document moving in one path may be used to generate a selectable number (one or more) of copies moving in a separate path. A semiautomatic or automatic document feeding system may be employed for the masters, in that the documents to be copied may involve limited (semiautomatic) or no (automatic) operator handling once a stack of masters is ready for input. The present system describes a semiautomatic document feed (SADF) by way of example only. A duplexing feature is incorporated in the transport mechanism for the copy document, in order that they may be stored after an image has been copied on one side and returned to receive an image on the other side.

In the exemplification of FIG. 1, the principal operative units comprise a master document transport system 10, an imaging system 12, a copy document transport system 14, and control circuits 16. The circuits are depicted as blocks within a separate functional unit labeled as control circuits 16 although it will be appreciated that in practice the circuits are physically distributed as advantageously as possible within the console. The imaging system 12 may incorporate any of a variety of conventional light sources, scanners and optics for transferring the image of a master document that is positioned within the master document transport system 12 onto a receiving mechanism or system. Although this image receiver is here a photoconductive member (drum) associated with the copy document transport system 14, this is chosen as an example simply because of the widespread use of such systems. Systems in accordance with the invention may alternatively be used with a number of different copier techniques, such as electrostatically chargeable papers, light beam (e.g. laser) scanning systems, arrays of light sensitive elements and the like. In the master document transport system 10 the documents are transferred to and past a fixed position which is herein termed in imaging station and defined by a platen or document glass 18. Details of the optical path, the light scanning mechanism and the photoconductive member, such as a typical drum 20, have been omitted for simplicity, as have the successive stations utilized in the electrophotographic reproduction process, such as the charging station, developer, and fuser. The interface between the drum 20 and a copy document moving along the copy document transport system 14 is herein broadly referred to as the image transfer station.

In the master document transport system 10 (referring now to both FIGS. 1 and 3), master documents to be reproduced are placed by the operator on an entry tray 24 and held by an entry roller 26 against an entry gate 27. The entry gate 27 is disposed adjacent a transport mechanism which forms a loop or recirculating path that is adjacent, in part, to the image station. Although rollers, guides and other conventional mechanisms may be used, as will be understood by those skilled in the art, an endless transport belt 28 wrapped about a pair of driver rollers 29 provides a suitable example of a readily mechanized system. The transport mechanism defines both a first (lower in FIG. 1) run which is adjacent the imaging station at the document glass 18 and a second (upper in FIG. 1) run, immediately above, which moves the master in the opposite direction. These runs are referred to as "lower" and "upper" hereafter for ease of visualization, and because of the attitude and location of the low profile semiautomatic feeder mechanism of FIG. 1. In other systems the physical disposition may be entirely different, as dictated by the overall configuration. A pre-entry sensor 30 positioned adjacent the entry roller 26 detects the presence of a document and provides an actuating signal utilized in the control circuits 16 to actuate the entry gate 27 at the proper time, in a fashion widely used in existing systems, such as the IBM Copier III, and therefore not described in detail.

At the downstream edge of the imaging station along the lower run is mounted an exit gate 34, for positioning of the master document at the imaging station, while along the upper run, at the downstream end of the storage station, is similarly mounted a storage gate 36. A jam detection switch 37 (FIG. 3 only) is mounted along the upper run to detect the timely presence of a master at the storage station. Each gate 34, 36 is opened when it is desired to move the master with the transport system. An exit diverter 38 positioned between the lower and upper runs can be moved selectively into position to intercept a master document exiting from the lower run. The document would otherwise be deposited on an exit tray 40 downstream from the lower run, but is instead inverted and turned upwardly through an approximately 180° arc onto the upper run, where guide rollers 42 aid in the paper drive toward the storage gate 6. Similarly, adjacent the downstream end of the upper run at the associated drive roller 29, an entry diverter 44 is positioned selectively to intercept the document from the upper run and return it, again reversed in direction and inverted in position, to the lower run. If the entry diverter 44 is not operated so as to be in position to intercept the document, the master follows a substantially straight line path from the upper run back to the entry tray 24, in which position it is inverted from its original position, and with its former trailing edge now being the leading edge, so that it is now in a juxtaposition which permits reentry for making a duplex copy. However, it may be preferred to utilize a separate tray for collecting duplex masters, as is described hereinafter in conjunction with FIG. 4.

In the copy document transport system 14, referring again only to FIG. 1, apart from a transport belt 50 and drive rollers 52 downstream of the image transfer station, most of the details of the flow path for the copy documents, such as gates, diverters, guides and drive rollers have been omitted for simplicity. A number of document sensor switches, however, are incorporated in various points along the paper path, which commences at a paper bin 54 and may be directed to a duplex storage bin 56, but in any event terminates at an exit pocket 58 (although a collator system may be employed if desired).

The paper sensor switches may comprise photoelectric, pneumatic or electromechanical devices for sensing the passage of a copy document. These sensors (designated SW) are positioned along all of the possible flow paths for the copy documents, so that a paper jam at any location may be ascertained. Within a predetermined time interval following the actuation of some prior mechanism, a sensor should detect the passage of a document past its location, and the failure to do so gives rise to the indication of a paper jam. Therefore a paper feed switch 60 is positioned downstream of the paper bin 54 and along the path toward the image transfer station. A pre-transfer switch 62 is positioned along this region, a drum image count switch 63 is positioned at the image transfer station and a post-transfer switch 64 is positioned downstream of the image transfer station. The copy document may thereafter be diverted into either of two paths, one leading to the exit pocket 58 and the other leading to the duplex storage bin 56. In the former path, there are disposed both an exit diverter switch 66 at a midstream location, and an exit pocket switch 68 in the exit pocket 58 region itself, the latter switch determining final and satifactory delivery of the copy document. In the alternate path leading to the duplex storage bin 56 is disposed a duplex entry switch 70, for detecting movement of copy documents into the duplex storage bin 56. Documents fed out of the duplex storage bin 56 are diverted back toward the image transfer station, and are detected before joining with the path from the paper bin 54 by a duplex exit switch 72. Consequently, even though a copy document may traverse the entire route from paper bin 54 past the image transfer station, into and out of the duplex storage bin 56, again past the image transfer station and then out to the exit pocket 56, its presence or absence at each critical juncture in the path will be detected by an appropriate switch so that a paper jam can be detected—the probable location can also be indicated to the operator if desired.

In the control circuits 16, jam detection circuits 80 each receive signals from the various switches 60–72 respectively, and may also receive signals from the various gates, diverters and actuators that are used in the copy document flow path and have not been shown in detail. In each instance, the jam detection circuits 80 operate in well understood fashion, to determine whether the copy document has reached the next appropriate position after some prior action has been performed or set of logical conditions has been met. For example, the paper feed switch 60 should detect the passage of a copy document within a predetermined time interval after actuation of the feed mechanism associated with the paper bin 54. The pretransfer switch 62 should detect the passage of a copy document within a predetermined time interval after actuation of either the paper feed switch 60 or the duplex exit switch 72. On the other hand, because a control gate (not shown) may be positioned before the image transfer station, the post-transfer switch 64 is conditioned to provide an indication of document passage within a predetermined time after opening of the gate, rather than the pretransfer switch 62. These functions are provided in well understood fashion by time delay relays, one-shot multivibrators or clock operated timing circuits, and have therefore not been depicted in detail. Similarly, the jam detection circuits 80, upon detecting the occurrence of a paper jam, shut off drive control circuits 82 and paper jam indicator circuits 84. When the jam has been cleared, the operator actuates start circuits 86 to recommence operations.

The number of copies to be made are set by the operator at a copy selector switch 88, and this data is transferred into a copy downcounter 90, which receives count signals from the exit pocket switch 68, and determines whether and when the desired number of correct copies have been made. The downcounter 90 circuits also receive signals from the paper feed switch 60 to control feeding of the proper number of documents from the paper bin 54.

The operator can also select the mode of operation for mode control circuits 92, which subsequently provide actuation signals to the gate control 94 and diverter controls 96, in sequences depending upon the mode selected (e.g. simplex only, simplex/duplex or duplex/-duplex). The gate controls 94 and diverter controls 96 are conventional and detailed descriptions thereof are omitted for simplicity. The drive control circuits 82 also are straightforward, but have additional inputs from start circuits 86, the jam detection circuit 80 and any paper position sensors, such as the sensor 30. Clearly, all such functions could be controlled by a microprocessor programmed to provide the sequencing of master documents through the transport system 10 in accordance with the mode desired. However, the functions performed are not complex, and separate circuits may advantageously be used, as shown.

Figure 3:
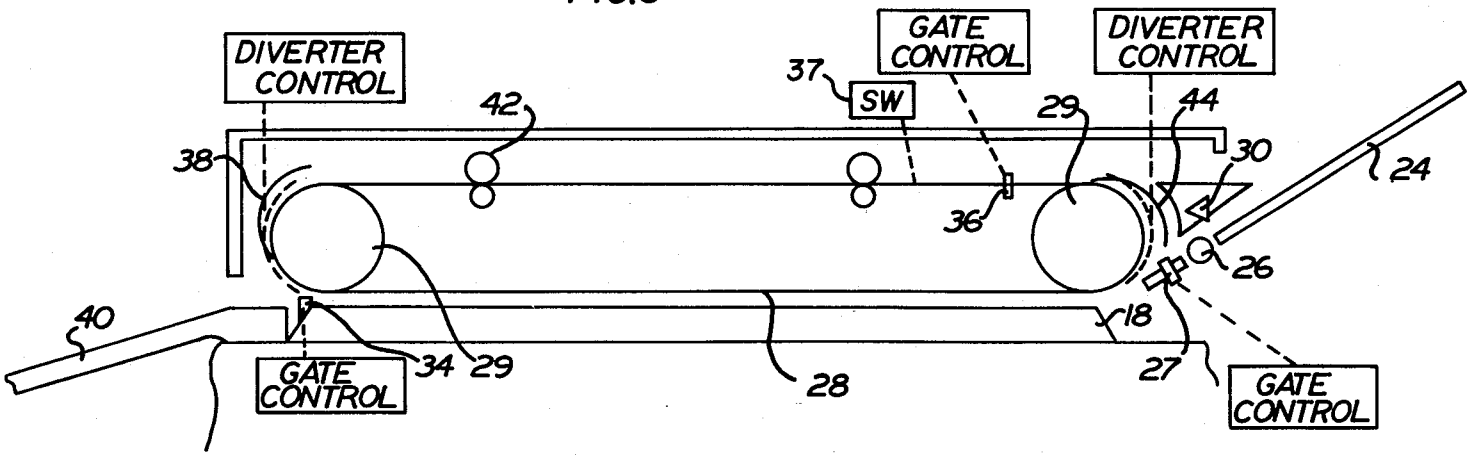
FIG. 3 is a side sectional view showing in greater detail the master document transport mechanism utilized in the system of FIG. 1.

It will be evident to those skilled in the art, referring to FIG. 1 and FIG. 3, that this document handler configuration permits a wide variety of mode options and master document handling possibilities. As a first example, consider the mode in which simplex masters are to be copied to provide a selected multiple number of duplex copy documents. With a semiautomatic document feed system, as shown herein, an operator has a stack of documents at the entry tray 26 that are to be copied in pairs, using both sides of the copy document. When fed in, the first master moves past the entry gate 27 and under the transport belt 28 to be positioned against the exit gate 34 and thus held at the imaging station. The imaging system 12 thus transfers the image of the master to the drum 20, as copy documents are fed successively from the paper bin 54 to the image transfer station adjacent the drum 20. As a series of illuminated images are projected and copy documents are fed past the image transfer station, the images are electrophotographically reproduced and fixed, then directed into the duplex storage bin 56. As soon as the last master document image has been illuminated through the document glass 18, the first master is moved by the transport belt 29 from the lower run adjacent the document glass and reversed by the exit diverter 38 to the upper run, where it is held at the storage gate 36. Concurrently, a second master is delivered into position at the imaging station. This action may be undertaken as soon as the last image illumination has been effected, when all of the first pages of the duplex copies have been prepared or the last copy is in the process of being made. The step of moving a new document onto the glass can thus be carried out concurrently with other steps and thus no added delay is introduced. In statistical terms, the great majority of copy document runs will be successfully completed and there is a substantial net savings in time achieved by advancing the master immediately, based on this assumption.

At the duplex storage bin 56, which is used when duplex copies are being made, the copy documents with reproductions on one side (referred to herein as the obverse) are temporarily stored with the reproduced image up (in this example). These documents are then fed out from the duplex storage bin 56 back into the flow path to the image tranfer station for receiving the second image on the reverse side. Because of the reversal of direction in moving from the duplex storage bin 56, the leading edge becomes the trailing edge, and because of the path followed through the copy document transport mechanism 14 the under side of the copy document now receives the image of the second master. After passing the image transfer station these copies are now diverted to the exit pocket 58. When the desired number of drum images has been counted at the drum image count switch 63, the master is no longer needed at the imaging station for reproduction purposes if no paper jam occurs. The master for the second page can be held at the image station until all copies have been received at the exit pocket 58, as detected by completion of the desired count by the copy downcounter 90 of copy documents moving to the exit pocket switch 68. In order to collect the sheets in the exit tray 40 in the same order as originally supplied, as well as to save time the transport belt 28 or other master document transport device is operated with both masters first being recirculated to the next succeeding run—i.e. with the exit diverter 38 and the entry diverter 44 causing turnaround of the documents at each end of the transport belt. Then, with the first master returned to the imaging station and the second master being at the storage station, the transport belt 28 can be stopped until a signal is received from the copy downcounter 90. If the signal is received earlier the transport mechanism is kept operating, but with the exit diverter 38 switched to eject the first master and then the second master onto the exit tray 40. This action requires approximately 500 milliseconds, but can be shortened to less than half that time if an inverted pair sequence (e.g. 2, 1, 4, 3, etc.) is permissible at the exit tray. In the event that a jam occurs in this simplex/duplex mode of operation, both masters remain available for making the correct number of proper copies without further action by the operator except for the necessary extraction of the jammed paper. The various conditions that can arise are treated in detail below.

Figure 2:
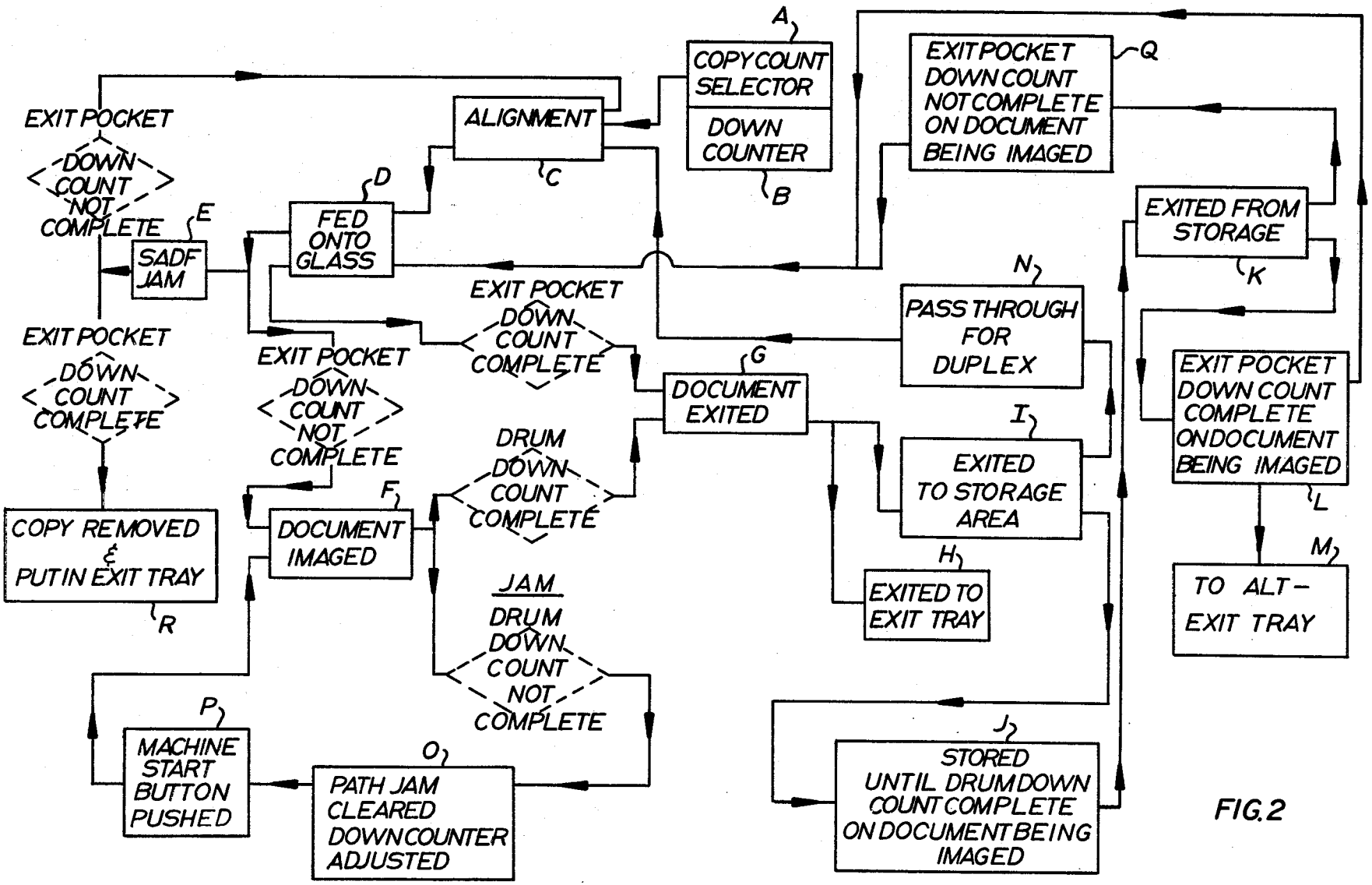
FIG. 2 is a flow diagram that illustrates successive functional states that can occur under different conditions of operation.

FIG. 2 is a flow diagram in which the rectangles represent possible successive functional steps or movements of the master document, while the diamonds (in dotted lines) represent events that must transpire in the copying system for successive movements of the master to take place. Examination of this flow chart relative to the system organization of FIG. 1 enables understanding of the sequences undertaken under various modes of operation, as well as actions taken during malfunctions in those modes. The following modes and conditions encompass the principal variations of interest. Reference should concurrently be made to the system arrangement of FIG. 1 from which the physical flow of documents can be visualized.

SADF Jam—The semiautomatic document feed system, comprising the master document transport system 10 and associated circuits, may detect that the master document has not been successfully aligned or fed onto the document glass 18. The pre-entry sensor 30 usually identifies such a condition. Inasmuch as proper positioning of the master is a precondition to subsequent copying operations, the following sequence occurs when each new master is to be imaged (referring particularly to the functional steps [rectangles] of FIG. 2):

A. Copy Count Selector—the operator selects, at the switch 88, the number of copies to be made.

B. Down Counter—the downcounter 90 is set automatically according to the copy count selected.

C. Alignment—the operator places the master under sensor 30 which commands roller 26 to align the master against gate 27.

D. Fed Onto Glass—the transport system 10 moves the master onto the document glass.

At this point, a SADF jam may occur, in that the master may not be properly positioned. In this even a corrective sequence is undertaken as follows:

E. SADF Jam—the operator clears the jam by removing the master from the glass 18 and refeeding the master, or positioning the master manually. Thus the sequence returns to the Alignment step, with the condition (dotted line diamond) being satisfied as to "Exit Pocket Down Count Not Complete" because no copy documents have reached the exit pocket sensor switch 68 which controls the final downcounting.

Once the master is in proper position, image transfer is to then be effected:

F. Document Imaged—the master document is held at the image transfer station until the "Drum Down Count Complete" condition is satisfied, which means that the drum image count switch 63 has activated the copy downcounter 90 to indicate that the last copy needed has left the image transfer position at the drum 20.

G. Document Exited—when "Drum Down Count Complete" exists, the master is fed out from the document glass 18. It can be recirculated or placed in an exit tray, as described hereafter.

Simplex Master/Simplex Copy Mode—After document imaging and exiting as described above, if no jams occur and only a simplex copy is to be made from a simplex master, the master is then:

H. Exited to Exit Tray—the master is not diverted upwardly to the storage station but the diverter 38 permits the document to pass to the exit tray 40.

Figure 4:
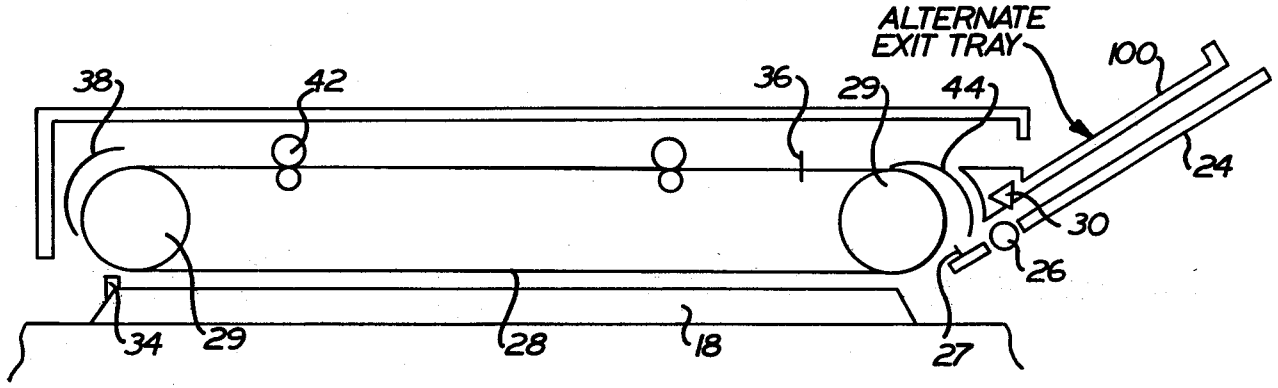
FIG. 4 is a side sectional view showing an alternative form of master document transport mechanism that may be employed in the system.

Simplex Master/Duplex Copy Mode—(No jams-alternate exit tray) A straightforward sequence is followed if no jams occur in the copy document path for making copies on both sides of a copy document from two different masters. This mode is based upon the use of an alternate exit tray 100 on the same side of the master document transport system 10 as the entry tray 24, as shown in FIG. 4. This arrangement has two primary advantages, in that (1) simple masters need not be recirculated onto the document glass 18 when no copy jam occurs, and (2) duplex masters can be delivered in the same sequence as entered without an added passage through the recirculation loop. With the alternate exit tray 100 being used, the copy document path is set (FIG. 1) so that after an image is fixed on one side of each copy document it is sent to the duplex storage bin 56, and again returned, inverted, to the drum 20 position for receiving the image of the next master on the reverse side. The sequence is as follows, for the master document, after it has been fed and imaged via the C, D, F, and G steps (FIG. 2):

I. Exited to Storage Area—the first master is shifted from the image transfer station to the storage station on the upper run of the transport belt 28.

J. Stored upon Drum Down Count Complete on Document Being Imaged—as the first master is held in storage the second is placed in image transfer position for the preparation of the needed duplex copies.

K. Exited from Storage—the storage gate 36 is opened to permit the master documents to transfer out.

L. Exited Pocket Down Count Complete on Document Being Imaged—when the exit pocket switch 68 has indicated delivery of the needed copies to the downcounter 90, the masters are no longer needed and can be transported out.

M. To Alternate Exit Tray—the diverter 44 is positioned, and the belt 28 is driven, so that the masters are delivered to the alternate exit tray 100.

Simplex Master/Duplex Copy (No Jams-Standard Exit Tray)—With the standard exit tray 40 (FIGS. 1 and 3) in use, with recirculation loop can be used in one of two ways, although the master proceeds from the document glass 18 to the storage station and then can be exited in the C, D, F, G, I, K, L sequence previously described. However, when the exit pocket downcount is complete, the second master is at the image transfer station, closer to the exit tray 40. Thus the faster way to exit the two masters is to open the exit gate 34 and shift the exit diverter 38 so that the following sequence occurs:

Second Master—proceeds directly through the D, G, H sequence to the exit tray 40.

First Master—on being exited from storage (K, L) returns (D) to the glass 18 at the image transfer station and then moved through the D, G, H sequence to the tray 40.

The immediately above sequences result in reversed pairs (e.g. 2, 1, 4, 3, 6, 5, etc.) at the exit tray 40. If this is not acceptable, then the proper order can be established by use of an additional half-revolution of the recirculation loop, at the cost of the time delay involved. For this purpose the diverter 38 first causes turnaround of the second master to the storage station, while the first master is returned back to the image transfer station. Thereafter the first and second masters can be exited serially as above described.

Duplex Master/Simplex Copy (No Jams)—A master document having images on both sides is run through the recirculation loop twice, the second time inverted and with the former leading edge becoming the trailing edge. The A, B, C, D, F, G, I sequence is followed in delivering the master to the storage station after imaging. The master is not held at the storage station but returned to the entry tray 24:

N. Pass Through for Duplex—the diverter 44 is positioned so that when the master passes the storage gate 36 it goes directly out to the tray 24, in which location it has the desired inverted and edge-reversed position. It may be fed again automatically as by an element (not shown) which impels the leading edge into the feed mechanism. Alternatively the operator may simply realign (C) and feed the master back through the D, F, G, H sequence in which it ends in the exit tray 40.

Simplex Master/Duplex Copy (Paper Path Jam During Imaging of 1st or 2nd Master)—A copy paper jam during imaging of a first simplex master used in making duplex copies requires corrective action based only on that master alone. If the jam occurs before the final exposure of the first simplex master, that master is simply held at the image station. Thus after the jam is cleared, image transfer for the first side of the duplex copy can be carried out until the desired number of copies are in the duplex bin. If the first simplex master has been imaged the desired number of times but a jam occurs during runout of the copies, a different procedure is followed because the second simplex master is made available at the image station during the runout interval. Therefore the second simplex master is imaged until the duplex bin is emptied. The needed corrective number of copies can then be made by returning the first master to the image station, sending the needed number of copies to the duplex bin, and then placing the second duplex master at the image station and copying on the reverse side. Alternatively, because some collators have a turnaround device (or a turnaround device can be added) the copies of the reverse side may be made first, drawing paper from the feed bin instead of the duplex bin. The first master can then be returned to the image station, the obverse copies added, and each document turned around in the collator or before reaching the exit tray.

A jam during imaging of a second master also requires re-imaging, in a variable amount dependent upon the number of copies lost, of both the simplex masters, and this will be described in more detail. The sequences are conveniently subdivided into pre-jam, jam and post-jam intervals. In the time span prior to the jam, the first master is imaged and then stored, in the A, B, C, D, F, G, I, J sequence. After imaging of the first master the second master goes into the C, D, F sequence. With the second master on the document glass 18 it is assumed that some arbitrary number of copies have been made when a jam occurs. At this point in time the "jam" condition is indicated at the same time "Drum Down Count Not Complete" exists, although the operator may be provided with an indication of the number of (duplex) copies delivered to the exit pocket.

Jam in copy documents—The occurrence of a jam with some duplex copies safely in the exit pocket 58 and an indeterminate number of copies in the paper path prior to the jam, or in the duplex storage bin 56, first requires clearance of the jam. It is assumed that the "Drum Down Count Not Complete" condition exists, although even if all copies had been made some might have been rendered unusable by the jam condition. Then the operator corrects the sequence, as follows:

O. Path Jam Cleared, Downcounter Adjusted Automatically—the paper in the system path (i.e. those copies not in the duplex bin or exit pocket) is extracted as the jam is cleared. Salvage of incomplete copies requires excessive handling and computation time as well as introducing unwanted complexity into the clearance procedure. The downcounter automatically establishes the number of replenishment copies needed to complete the desired total. This quantity may be established, either immediately upon jam clearance if the number of copies in the duplex bin or exit pocket have been counted, or later when an inadequate number of copies have reached the exit pocket. The operator may also reset the downcounter to a new number to give the desired final total.

P. Machine Start Button Pushed—restarting of the copier in this mode, with the two simplex masters at different positions, undertakes the post-jam sequence for duplex copies of simplex masters.

Post-Jam Sequence—Imaging of the second simplex master is recommended and continued until the duplex bin is emptied unless there were no copies remaining in the duplex bin. Then the first simplex master is recirculated back to the image station from the storage phase (J), first being exited from storage (K). Concurrently, the second simplex master is exited (G) to the storage station (I, J) from the imaging phase (F), although the drum downcount is not complete. Thus the copying can recommence with the first simplex master at the image transfer station and the second simplex master at the storage station. Alternatively, with a turnaround device in the copy document handler, the procedure of keeping the second simplex master at the image station and copying the reverse side of copy documents from the paper bin first, followed by copying of the obverse and subsequent turnaround, can be utilized at this time.

When the first simplex master has been imaged the desired number of times for the "Drum Down Count Complete" condition, it again is moved to storage (I, J), and held while the second simplex master is returned to the image transfer position (K, L, D). When the second simplex master has been imaged the desired adjusted number of times and the "Exit Pocket Down Count Complete" condition met, the two simplex masters are exited, with the first simplex master being fed out first (K, L, D, G, H) while the second simplex master is returned past the storage station (G, I, J) before following the same exiting sequence (K, L, D, G, H).

Duplex Master/Duplex Copy (Jam on Imaging of Second Master)—As in the example above, a copy document jam after completion of imaging of the first side of a duplex master or during imaging of the second side of a duplex master introduces more complex problems than if the jam occurs prior to completion of imaging the first side. The more difficult procedure is thus described hereafter, it being assumed that the first duplex master side has been fed, copied and returned for completion of duplexing to the entry side via the sequence A, B, C, D, F, G, I, N and back for alignment at C. The second duplex master side can then be advanced to imaging (C, D, F), at which point a jam is assumed to occur in the copy document path. The jam procedure is then as previously described (phases O and P), with discard of waste and incomplete copies. When the copier restarts the copying of the second site of the master is carried out until the duplex bin is emptied. The master is then returned (G, I, N) and is received by the operator in the original (first side) portion to enable the subsequent automatic completion of the run to make up the loss in the jam.

Assuming that no further jams occur, the master is again passed twice into the machine in the sequence C, D, F, G, I, N, being returned to the entry tray 24 both times. After all copies are made the operator can simply transfer the master from entry tray to the exit tray. Alternatively, the master can be fed through one final time in a "No Copy" mode to pass directly across the document glass to the exit tray in a sequence C, D, G, H. The imaging step is bypassed because the "Exit Pocket Down Count Complete" condition is satisfied.

SADF Jam (Exit Pocket Down Count Complete)—In the event that a master document jam arises but copies have been made correctly, the operator need only remove the master and place it in the exit tray 40, as shown by phase D.

Summary—It will be evident to those skilled in the art that copiers in accordance with the present invention substantially simplify document handling problems in the event of paper jams, by both retaining masters for subsequent use in the event needed and affording a number of options as to document handling and delivery. These features are achieved with a low profile, easily manipulated master document transport system that accepts documents via a conventional entry system.

Although various forms and modifications have been described above, it will be appreciated that the invention encompasses all variations and expedients falling within the scope of the appended claims.

What is claimed is:

1. A system for handling documents to be fed past an image station comprising:

a document transfer mechanism having a first run adjacent the image station and a second run adjacent thereto, and including first diverter means for selectively curving the document from the first run toward the second run in inverted position, and second diverter means for selectively curving the document from the second run toward the first run in a reinverted position, whereby the document is recirculated past the image station;

first controllable gate means positioned to hold the document at the image station;

second controllable gate means positioned along the second run to hold the document at a storage station therealong;

document entry means positioned adjacent the first run of the transfer mechanism for supplying documents to the transfer mechanism; and document exit means positioned adjacent the transfer mechanism on the same side as the document entry means, adjacent the second diverter means and above the document entry means to receive documents ejected from the transfer mechanism.

2. A system for handling documents to be fed past an image station comprising:

a document transfer mechanism having a first run adjacent the image station and a second run adjacent thereto, and including first diverter means for selectively curving the document from the first run toward the second run in inverted position, and second diverter means for selectively curving the document from the second run toward the first run in a reinverted position, whereby the document is recirculated past the image station;

first controllable gate means positioned to hold the document at the image station;

second controllable gate means positioned along the second run to hold the document at a storage station therealong;

document entry means positioned adjacent the first run of the transfer mechanism for supplying documents to the transfer mechanism;

document exit means positioned adjacent the transfer mechanism to receive documents ejected therefrom; and means for detecting system malfunctions, said last mentioned means being coupled to control the first and second diverter means and the first and second gate means selectively to change the sequence of diversion of the document from the image station to the document exit means or to the next run.

3. The invention as set forth in claim 2 above, wherein said system further comprises means disposed adjacent said second gate means for receiving inverted documents for return to the image station.

4. In a document copier in which a master may have to be reused in making additional copies due to paper jams or for duplexing of copies, the combination comprising:

a document image station at which the master is to be positioned during imaging;

a document recirculating transport mechanism adjacent the image station, and including means defining a recirculating drive spanning the image station and defining a recirculation path, the transport mechanism further defining a storage station adjacent thereto but spaced apart therefrom;

document entry means disposed to feed documents into the transport mechanism, the transport mechanism further including means for returning a document from the storage station to the image station, or alternatively ejecting the document from the transport mechanism;

first selectively operable diverter means adjacent the side opposite the entry means for diverting the document to the storage station along the recirculating drive;

selectively operable gate means for retaining the document at the storage station; and second selectively operable diverter means disposed adjacent the entry means for (1) returning the document along the recirculating drive to the image station or (2) directing the document to the entry means.

5. In a copying system in which it is desired to generate copies without rehandling of a master when jams occur in the copy documents, the combination comprising:

transport means for copy documents, including a copy station;

means disposed along the transport means for detecting jams in the copy document flow;

means responsive to the operation of the transport means and the means for detecting jams to count the number of copy documents provided from the system;

a variable path master document transport system for receiving a master, and passing the master through an image transfer position, said master document transport system including means having a storage area for recirculating the master, and alternatively feeding the master to an exit area, said master document transport system being responsive to the means for detecting jams to direct the master out to the exit area or alternatively to direct the master to the storage area for subsequent return to the image transfer position for a second imaging, wherein the master is retained in a recoverable position for further imaging if a paper path jam occurs.

6. The invention as set forth in claim 5 above, wherein the copy document transport means includes means for recirculating the copy documents past the copy station in inverted position for duplexing, and wherein the master document transport system comprises means for inverting the master.

7. The invention as set forth in claim 6 above, wherein the master document transport system further comprises a feed tray positioned adjacent the storage area to receive inverted masters, and wherein said means for inverting the master is disposed at the storage area, and comprises diverter means for directing the inverted master to the feed tray.

8. A document handler for use with an electrophotographic copier in which a latent image of a master document positioned at an imaging station is formed on a photoconductor, and at a later time a copy document bearing the image is transported to an exit area from an image transfer station, with a selectable number of copy documents being made and there being a possible jam in the transport of copy documents to the exit area comprising:

a master document transport mechanism having a first run adjacent the imaging station and a second run spaced apart from the imaging station, the transport mechanism including means for returning the master from the second run to the first run;

means for identifying image transfer of a selected number of copy documents, said means being coupled to control said master document transport mechanism to transfer master documents from the first run to the second run;

a copy document transport mechanism positioned to advance the copy documents successively past the image transfer station to the exit area;

means including sensor means disposed along the copy document transport mechanism, for detecting a jam in copy sheet movement; and means responsive to said means for detecting and coupled to control said master document transport mechanism for returning documents from the second run to the first run in the event of occurrence of a jam, and for ejecting the master document in the event a jam does not occur.

9. The invention as set forth in claim 8 above, wherein said copy document transport mechanism further includes means, including a duplex storage bin, for recirculating the copy documents in inverted position to provide copies on both sides thereof.

10. The invention as set forth in claim 9 above, wherein said document handler further includes duplex tray means adjacent the second run, and first diverter means positioned between the second run and the duplex tray means for (1) diverting the master document to the duplex tray means when only one side thereof has been exposed to the imaging station and (2) transferring the master document past the first run and out from the master document transport mechanism when both sides thereof have been exposed to the imaging station and no jam has occurred.

11. The invention as set forth in claim 8 above, wherein said copy document transfer mechanism includes means, including a duplex storage bin, for recirculating the copy documents in inverted position to provide copies on both sides thereof, and wherein said document handler further includes exit tray means adjacent the first run, and exit diverter means disposed between the first run and the second run for (1) ejecting documents from the first run when duplex copies have successfully been made from simplex masters.

* * * * *